US010005584B2

(12) United States Patent
Tanaka

(10) Patent No.: US 10,005,584 B2
(45) Date of Patent: Jun. 26, 2018

(54) SYNTHETIC RESIN BOTTLE

(71) Applicant: Toshimasa Tanaka, Tokyo (JP)

(72) Inventor: Toshimasa Tanaka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days. days.

(21) Appl. No.: 14/766,603

(22) PCT Filed: Dec. 17, 2013

(86) PCT No.: PCT/JP2013/007414

§ 371 (c)(1),
(2) Date: Aug. 7, 2015

(87) PCT Pub. No.: WO2014/132313

PCT Pub. Date: Sep. 4, 2014

(65) Prior Publication Data

US 2015/0367979 A1 Dec. 24, 2015

(30) Foreign Application Priority Data

Feb. 28, 2013 (JP) ..... 2013-040000

(51) Int. Cl.
*B65D 1/02* (2006.01)
*B65D 79/00* (2006.01)

(52) U.S. Cl.
CPC ..... *B65D 1/0276* (2013.01); *B65D 1/0207* (2013.01); *B65D 1/0261* (2013.01); *B65D 1/0284* (2013.01); *B65D 79/005* (2013.01)

(58) Field of Classification Search
CPC .. B65D 1/0261; B65D 1/0207; B65D 1/0276; B65D 1/0284

(Continued)

(56) References Cited

U.S. PATENT DOCUMENTS

D741,187 S * 10/2015 Didier ..... D9/538
2002/0153343 A1 10/2002 Tobias et al.

(Continued)

FOREIGN PATENT DOCUMENTS

EP 2368804 A1 9/2011
FR 2969987 A1 7/2012

(Continued)

OTHER PUBLICATIONS

Sep. 1, 2015 International Preliminary Report on Patentability issued in International Patent Application No. PCT/JP2013/007414.

(Continued)

*Primary Examiner* — Ernesto Grano
(74) *Attorney, Agent, or Firm* — Oliff PLC

(57) ABSTRACT

This disclosure relates to a synthetic resin bottle that exhibits a reduced pressure absorbing function by the bottom portion being displaced inward. A bottom portion includes: a peripheral portion having an annular shape; a protruding ridge disposed radially inward of the peripheral portion and configured to serve as a ground contacting portion of the synthetic resin bottle by protruding downward from the peripheral portion and configured, when deformed under a reduced pressure, to make the peripheral portion serve as the ground contacting portion by displaced toward an inside of the synthetic resin bottle (i.e., upward); and a depressed recess located radially inward of the protruding ridge and depressed toward the inside of the synthetic resin bottle. The peripheral portion includes a plurality of groove portions extending radiately.

2 Claims, 4 Drawing Sheets

(58) Field of Classification Search
USPC ..... 215/374
See application file for complete search history.

(56) References Cited

U.S. PATENT DOCUMENTS

| | | | | |
|---|---|---|---|---|
| 2003/0196926 | A1* | 10/2003 | Tobias | B65D 1/0284 206/509 |
| 2004/0094502 | A1* | 5/2004 | Boukobza | B65D 1/0284 215/375 |
| 2005/0035084 | A1* | 2/2005 | Simpson, Jr. | B65D 1/0223 215/396 |
| 2007/0012648 | A1* | 1/2007 | Gatewood | B65D 1/0223 215/375 |
| 2007/0199915 | A1* | 8/2007 | Denner | B65D 79/005 215/375 |
| 2007/0215571 | A1* | 9/2007 | Trude | B29C 49/08 215/373 |
| 2009/0194546 | A1* | 8/2009 | Lane | B65D 1/0261 220/673 |
| 2009/0283495 | A1* | 11/2009 | Lane | B65D 79/005 215/383 |
| 2009/0321386 | A1* | 12/2009 | Lane | B65D 1/0276 215/384 |
| 2010/0163513 | A1 | 7/2010 | Pedmo | |
| 2010/0199611 | A1 | 8/2010 | Pedmo et al. | |
| 2010/0219152 | A1* | 9/2010 | Derrien | B65D 1/0276 215/374 |
| 2010/0297375 | A1* | 11/2010 | Protais | B65D 1/0284 428/36.92 |
| 2011/0079575 | A1* | 4/2011 | Wurster | B65D 1/0246 215/383 |
| 2011/0168662 | A1* | 7/2011 | Harris | B65D 90/36 215/381 |
| 2012/0097635 | A1* | 4/2012 | Yourist | B65D 1/0276 215/381 |
| 2014/0069884 | A1* | 3/2014 | Paredes | B65D 21/0217 215/10 |
| 2014/0123603 | A1* | 5/2014 | Denner | B67C 3/045 53/440 |

FOREIGN PATENT DOCUMENTS

| | | | |
|---|---|---|---|
| JP | 2007-269392 | A | 10/2007 |
| JP | 2008-068898 | A | 3/2008 |
| JP | 2012-096798 | A | 5/2012 |
| JP | 2013-006630 | A | 1/2013 |
| JP | 2013-079096 | A | 5/2013 |
| WO | 2010/061758 | A1 | 6/2010 |

OTHER PUBLICATIONS

Mar. 25, 2014 International Search Report issued in International Patent Application No. PCT/JP2013/007414.
Oct. 21, 2015 Office Action issued in Taiwanese Patent Application No. 103100001.
Jun. 30, 2016 Office Action issued in Canadian Patent Application No. 2,900,447.
Feb. 14, 2017 Office Action issued in Japanese Patent Application No. 2013-040000.
Jan. 24, 2017 Office Action issued in Australian Patent Application No. 2013380118.
Aug. 3, 2016 search report issued in Australian patent application No. 2013380118.
Sep. 27, 2016 Search Report issued in European Patent Application No. 13876638.1.
Sep. 6, 2016 Office Action issued in Japanese Patent Application No. 2013-040000.
Mar. 24, 2017 Office Action issued in Canadian Patent Application No. 2,900,447.

* cited by examiner

SYNTHETIC RESIN BOTTLE

TECHNICAL FIELD

This disclosure relates to a synthetic resin bottle, in particular, to a synthetic resin bottle that includes a trunk portion having excellent shape retention and that also includes a bottom portion configured, when an inside of the synthetic resin bottle is placed in a reduced pressure state, to be displaced inward to absorb the reduced pressure.

BACKGROUND

Conventional methods for filling synthetic resin (e.g., polyethylene terephthalate) bottles with contents such as juice beverages and tea include the one called "high temperature filling" in which a bottle is filled with the content at a temperature of, for example, about 90° C. to sterilize the content and the bottle and then, immediately capped and sealed. Since the bottle is sealed and subsequently cooled in the high temperature filling, the inside of the bottle is placed under a significantly reduced pressure. For this reason, measures are taken to prevent the appearance of the bottle from undergoing unsightly deformation by providing the trunk portion with an area (so-called a reduced pressure absorbing panel) that is easily deformable or by allowing the bottom portion to be displaced toward the inside of the bottle (for example, refer to Patent Literature 1). When the bottom portion is imparted with a reduced pressure reducing function as in Patent Literature 1, design flexibility is enhanced because there is no need to provide the reduced pressure absorbing panel in the trunk portion, which attracts attention as the bottle appearance. Moreover, since there is no need for such a deformable reduced pressure absorbing panel, the trunk portion advantageously maintains its surface rigidity and exhibits excellent shape retention.

CITATION LIST

Patent Literature

PTL 1: WO2010061758A1

SUMMARY

Meanwhile, regarding bottles used for foods or the like, the representative of which is a so-called PET bottle, efforts are being made to reduce thicknesses and weights of the bottles for resource saving in consideration of the environment and cost reduction, and a bottle including the bottom portion imparted with the reduced pressure absorbing function as described in Patent Literature 1 is not exceptional. However, reducing the thickness of the trunk portion of the bottle inevitably decreases the surface rigidity of the trunk portion, and this raises the probability of the trunk portion undergoing improper deformation when the inside of the bottle is placed under the reduced pressure state. Accordingly, improvement has been needed in terms of facilitating the deformation of the bottom portion for achieving both the weight reduction of the bottle and the satisfactory appearance of the trunk portion.

This disclosure is to overcome the above fact and relates to a synthetic resin bottle that exhibits the reduced pressure absorbing function by the bottom portion being displaced toward the inside of the bottle. This disclosure is to provide a novel synthetic resin bottle that facilitates the deformation of the bottom portion, thereby promoting the weight reduction while preventing the appearance from undergoing unsightly deformation.

One aspect of this disclosure resides in a synthetic resin bottle including a mouth portion from which a content is dispensed, a shoulder portion, a trunk portion, and a bottom portion, all of which are integrally formed in sequence, the bottom portion being configured to be deformed toward an inside of the synthetic resin bottle under a reduced pressure generated in the inside, thereby exhibiting a reduced pressure absorbing function. The bottom portion includes: a peripheral portion having an annular shape; a protruding ridge disposed radially inward of the peripheral portion and configured to serve as a ground contacting portion of the synthetic resin bottle by protruding downward from the peripheral portion and configured, when being deformed under the reduced pressure, to make the peripheral portion serve as the ground contacting portion by being displaced toward the inside of the synthetic resin bottle; and a depressed recess located radially inward of the protruding ridge and depressed toward the inside of the synthetic resin bottle. The peripheral portion includes a plurality of groove portions extending radiately.

Preferably, the plurality of groove portions is tapered radially inward.

Preferably, the plurality of groove portions is distributed at an equal interval in a circumferential direction.

When the bottom portion of the bottle includes: the peripheral portion having the annular shape; the protruding ridge configured to serve as the ground contacting portion of the synthetic resin bottle by protruding downward from the peripheral portion and configured, when being deformed under the reduced pressure, to make the peripheral portion serve as the ground contacting portion by being displaced toward the inside of the bottle; and the depressed recess located radially inward of the protruding ridge and depressed toward the inside of the bottle, and when the peripheral portion includes the plurality of groove portions extending radiately, upon generation of the reduced pressure inside the bottle, stress is focused on the groove portions, thereby facilitating the displacement of the bottom portion toward the inside of the bottle. As a result, when the inside of the bottle is under the reduced pressure, the bottom portion is preferentially deformed prior to the remaining portions (such as the trunk portion), and the bottle, even when reduced in weight (thickness), is prevented from undergoing unsightly deformation. Furthermore, since the displacement of the bottom portion tends to be induced, an absorbable volume of the reduced pressure is further increased.

When the groove portions are tapered radially inward, the stress is focused on the groove portions more effectively, and the displacement of the bottom portion is further facilitated.

When the plurality of groove portions is distributed unevenly in the circumferential direction, there is variation from one portion to another in terms of ease or difficulty of deforming toward the inside of the bottle. Accordingly, when being displaced inward, the bottom portion is inclined relative to the horizontal direction, possibly resulting in an adverse effect on the ground contact stability, the appearance, and the like. On the other hand, when the groove portions is distributed at an equal interval in the circumferential direction, the stress focused on the groove portions is dispersed evenly throughout the circumferential direction, and there is no variation from one portion to another in terms of ease or difficulty of deformation. This enhances the ground contact stability and further prevents unsightly deformation.

DETAILED DESCRIPTION

An embodiment is described in more detail below with reference to the drawings.

Figure 1:
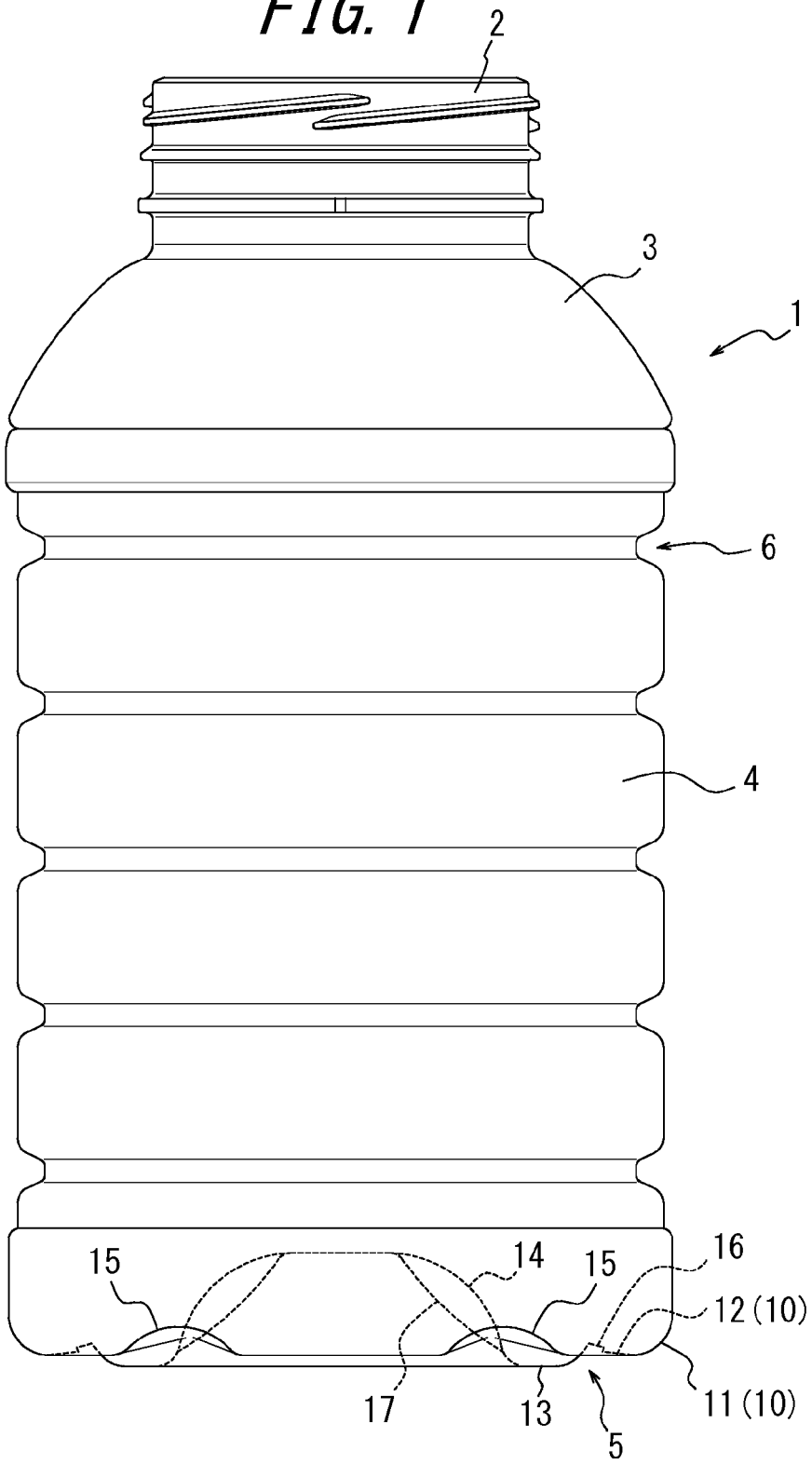
FIG. 1 is a side view illustrating a synthetic resin bottle according to an embodiment.
Figure 2:
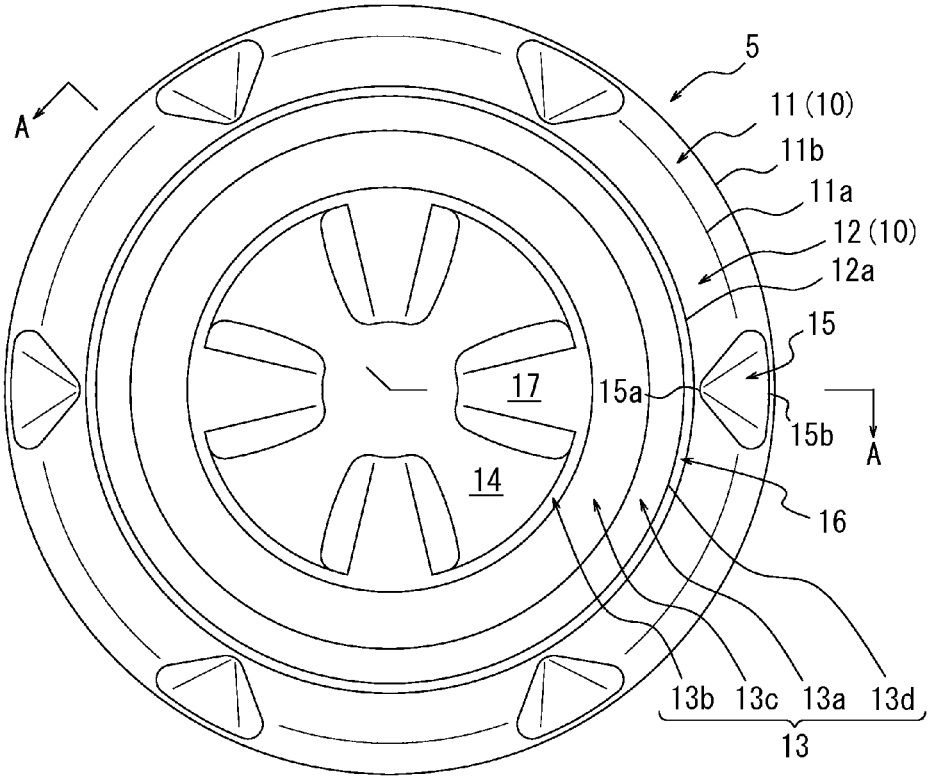
FIG. 2 is a bottom view of the bottle illustrated in FIG. 1.
Figure 3:
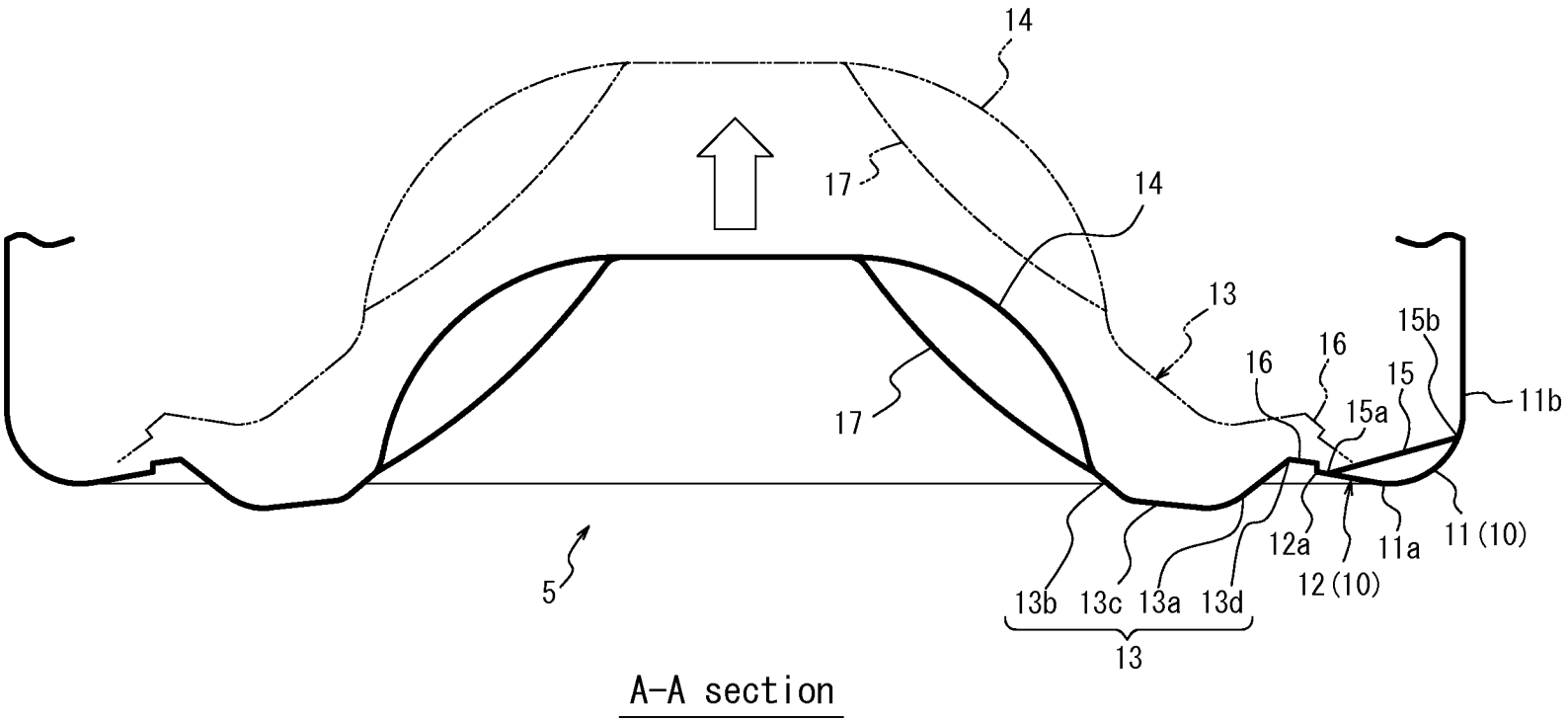
FIG. 3 is a partially enlarged sectional view taken along a line A-A in FIG. 2 of a vicinity of a bottom portion of the bottle illustrated in FIG. 1.
Figure 4:
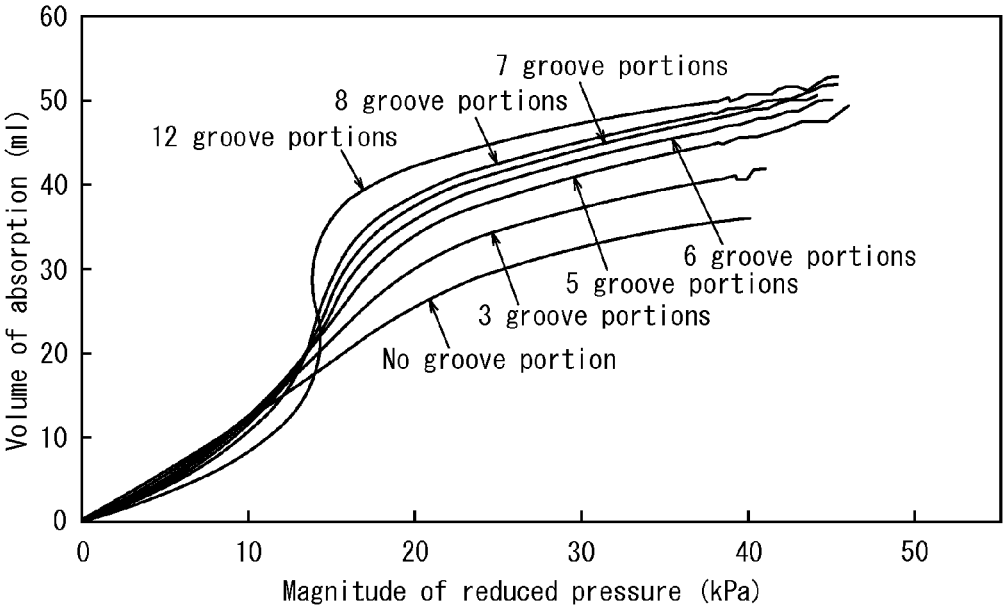
FIG. 4 is a graph illustrating, for the bottle illustrated in FIG. 1 and a bottle including a varied number of groove portions with respect to the bottle illustrated in FIG. 1, a relation between the magnitude of a reduced pressure and the volume of absorption.

FIG. 1 is a side view illustrating a synthetic resin bottle according to an embodiment, FIG. 2 is a bottom view of the bottle illustrated in FIG. 1, FIG. 3 is a partially enlarged sectional view taken along a line A-A in FIG. 2 of a vicinity of a bottom portion of the bottle illustrated in FIG. 1, and FIG. 4 is a graph illustrating, for the bottle illustrated in FIG. 1 and a bottle including a varied number of groove portions with respect to the bottle illustrated in FIG. 1, a relation between the magnitude of a reduced pressure and the volume of absorption. Note that a two-dot chain line in FIG. 3 represents an example of the bottom portion being displaced upward during absorption of the reduced pressure.

In the figures, reference numeral 1 denotes a synthetic resin bottle (hereinafter, simply referred to as a "bottle") according to the embodiment. The bottle 1 includes a cylindrical mouth portion 2 that is opened in an upper side thereof. The bottle 1 also includes a shoulder portion 3, a cylindrical trunk portion 4, and a bottom portion 5 that are integrally connected to the mouth portion 2. Inside the bottle 1, inner space is defined to contain a content.

The trunk portion 4 includes (in the present embodiment, a total of five) peripheral grooves 6 extending annually in the circumferential direction. The peripheral grooves 6 help enhance the surface rigidity and provide excellent shape retention of the trunk portion 4. The rigidity (such as the surface rigidity and buckling strength) of the trunk portion 4 may be enhanced by various other appropriate ways such as by providing the trunk portion 4 with longitudinal ribs for reinforcement.

The bottom portion 5 includes a peripheral portion 10 having an annular shape that is located radially outermost in the bottom portion 5. The peripheral portion 10 includes a heel wall portion 11 having a curved shape that is connected to a lower end edge of the trunk portion 4, and a flat portion 12 having an annular shape that is located radially inward of the heel wall portion 11. The bottom portion 5 also includes a protruding ridge 13 disposed radially inward of the peripheral portion 10. The protruding ridge 13 protrudes downward from the peripheral portion 10. The protruding ridge 13 is configured to serve as a ground contact portion of the bottle 1 and also configured, when being deformed under a reduced pressure (during absorption of the reduced pressure), to impart the peripheral portion 10 with the role of the ground contacting portion by being displaced toward the inner space of the bottle above a lower end of the peripheral portion 10. A depressed recess 14 is also disposed radially inward of the protruding ridge 13. The depressed recess 14 has a shape that is depressed toward the inner space of the bottle. Furthermore, the peripheral portion 10 is provided with groove portions 15 that are each recessed toward the inner space.

As illustrated in detail in FIG. 3, the flat portion 12 in the present embodiment is formed continuously from an inner peripheral end edge 11*a* of the heel wall portion 11 and is inclined upward as it extends radially inward. In this respect, it should be noted that the high temperature filling makes the synthetic resin more likely to be softened due to the temperature of the content and also brings the inside of the bottle to a pressurized state due to the filling pressure, and that the resulting stress acting downward on a bottom wall might places the bottom wall at the risk of undergoing downwardly bulging deformation. However, by increasing an inclination angle of the flat portion 12 with respect to the horizontal direction, the bulging deformation is effectively prevented. Nevertheless, increasing the inclination angle of the flat portion 12 excessively will hinder the upward displacement of the bottom portion 5. Accordingly, the inclination of the flat portion 12 may be appropriately selected in consideration of balance between the effect of preventing the bulging deformation of the bottom portion and the reduced pressure absorbing function. Additionally, depending on the type of the content and conditions of heat filling, the flat portion 12 may extend along the horizontal direction without inclination.

The protruding ridge 13 in the present embodiment includes an outer circumferential portion 13*a*, an inner circumferential portion 13*b*, and a toe portion 13*c* having a flat shape and disposed between the outer circumferential portion 13*a* and the inner circumferential portion 13*b*, and thus, the protruding ridge 13 in its section has a substantially trapezoidal shape. The toe portion may be curved to have a U-shape. Although in the present embodiment the toe portion 13*c* is slightly inclined upward as it extends radially inward, the toe portion 13*c* may also extend in the horizontal direction.

In the present embodiment, an groove recess 16 is also formed between an inner peripheral end edge 12*a* of the flat portion 12 and an outer peripheral end edge 13*d* of the protruding ridge 13. Forming the groove recess 16 facilitates the displacement of the bottom portion 5 and promotes smooth upward displacement. Furthermore, because the thickness of the bottom portion 5 is not necessarily uniform, when being displaced upward, a portion of the bottom portion 5 that is easier to deform is more preferentially displaced. Accordingly, the upward displacement of the bottom portion 5 proceeds while creating a crease line that undergoes concave and convex deformation in the circumferential direction and that extends radiately. Hence, the creasing line, when advancing radially outward, might places the peripheral portion 10, which serves as the ground contacting portion, at the risk of undergoing deformation. On the other hand, forming the groove recess 16 prevents the advance of the creasing line by the groove recess 16, and accordingly, prevents the deformation of the peripheral portion 10 effectively and lets the peripheral portion 10 exert the role of the ground contacting portion in a stable manner. Additionally, depending on the type of the content and conditions of heat filling, the groove recess 16 may be omitted, and the flat portion 12 may be directly connected to the protruding ridge 13.

The depressed recess 14 in the present embodiment has a sectional shape including a side portion that is curved to bulge toward the inner space and a top portion that extends flat in the horizontal direction. The depressed recess 14 also includes reinforcing ribs 17 that bulge toward the outside of the bottle 1 and that extend radiately (in the present embodiment, as illustrated in FIG. 2, a total of four reinforcing ribs 17 are arranged at an equal interval in the circumferential direction). The sectional shapes of the depressed recess 14 and the reinforcing ribs 17, and the number of the reinforcing ribs 17 may be appropriately changed.

As illustrate in FIG. 2, the groove portions 15 are arranged radiately in the peripheral portion 10 and, in the present embodiment, (a total of six groove portions 15) are distributed at an equal interval in the circumferential direction. When viewed from the bottom, the groove portions 15 each have a shape tapered as it extends radially inward, that is to say, a substantially triangular shape. As illustrated in FIG. 3, the groove portion 15, in the section taken in a middle portion thereof, also includes an inner peripheral end edge 15*a* that is located radially outward of the inner peripheral end edge 12*a* of the flat portion 12 and an outer peripheral end edge 15*b* that is located radially inward of the outer peripheral end edge 11*b* of the heel wall portion 11 (where, the outer peripheral end edge 11*b* refers to a portion that connects to the lower end edge of the cylindrical trunk portion 4), and is inclined upward as the groove portion 15 extends radially outward. Although in the present embodiment the groove portions 15 are not connected to the groove recess 16, the groove portions 15 may be connected to the groove recess 16. The shape of each groove portion 15 is not limited to the aforementioned substantially triangular shape and may be appropriately selected. For example, the shape of each groove portion 15 may be a substantially circular, an elliptical, an oblong, a rectangular, or a trapezoidal shape.

When the bottle 1 structured as above is filled with the content at a high temperature and is cooled after the mouth portion 2 is capped, the inside of the bottle 1 is placed in a reduced pressure state, and as illustrated by the two-dot chain line in FIG. 3, the bottom portion 5 is displaced upward toward the inner space of the bottle 1.

The present inventor studied stress distribution of a bottle modeled upon the embodiment illustrated in FIGS. 1 to 3 in a state where the bottom portion is deformed (displaced due to deformation) by using predetermined magnitudes of the reduced pressure, and the present inventor has found that the stress is focused more on the groove portions 15 than on the remaining portions and that the displacement of the bottom portion 5, starting from the groove portions 15, toward the inner space is facilitated. In particular when the groove portions 15 each have the shape tapered as it extends radially inward as in the present embodiment, the stress focused on the outer peripheral end edge 15*b* is dispersed throughout the circumferential direction, and the outer edge of the peripheral portion 10 is prevented from having a polygonal shape when viewed from the bottom. As a result, the ground contact stability and the appearance are favorably maintained.

FIG. 4 is a graph resulted from simulation of a relation between the magnitude of the reduced pressure and the volume of absorption of the reduced pressure that is absorbable at the corresponding magnitude for bottom portions of bottles modeled upon the present embodiment (each having a capacity of 1680 ml). As is clearly seen from FIG. 4, compared with a bottle not provided with a groove portion, bottles provided with groove portions all increase the volumes of absorption. In detail, the increases in the volumes of absorption were observed in a range of the magnitude of reduced pressure that is equal to or above 15 kPa. It can also be seen that, as the number of the groove portions is increased, the volume of absorption is also increased accordingly. That is to say, the increase in the volume of absorption means that the bottom portion is likely to be displaced at a low magnitude of the reduced pressure.

When the plurality of groove portions 15 is distributed unevenly in the circumferential direction, there is variation from one portion to another in terms of ease or difficulty of deforming upward. Accordingly, when being displaced upward, the position of the bottom portion 5 is inclined relative to the horizontal direction, possibly resulting in an adverse effect on the ground contact stability, the appearance, and the like. On the other hand, when the groove portions 15 is distributed at an equal interval in the circumferential direction as in the present embodiment, the stress focused on the groove portions 15 is dispersed evenly throughout the circumferential direction, and the position of the bottom portion 5 is substantially in parallel with the horizontal direction. This enhances the ground contact stability and further prevents unsightly deformation.

INDUSTRIAL APPLICABILITY

Since the inward displacement of the bottom portion is facilitated, a novel synthetic resin bottle that has a reduced thickness and yet, does not undergo unsightly deformation in the appearance is provided.

REFERENCE SIGNS LIST

1 bottle
2 mouth portion
3 shoulder portion
4 trunk portion
5 bottom portion
6 peripheral groove
10 peripheral portion
11 heel wall portion
11*a* inner peripheral end edge of heel wall portion
11*b* outer peripheral end edge of heel wall portion
12 flat portion
12*a* inner peripheral end edge of flat portion
13 protruding ridge
13*a* outer circumferential portion
13*b* inner circumferential portion
13*c* toe portion
13*d* outer peripheral end edge of protruding ridge
14 depressed recess
15 groove portion
15*a* inner peripheral end edge of groove portion
15*b* outer peripheral end edge of groove portion
16 groove recess
17 reinforcing rib

The invention claimed is:

1. A synthetic resin bottle comprising a mouth portion from which a content is dispensed, a shoulder portion, a trunk portion, and a bottom portion, all of which are integrally formed in sequence, the bottom portion being configured to be deformed toward an inside of the synthetic resin bottle under a reduced pressure generated in the inside, thereby exhibiting a reduced pressure absorbing function, wherein:

the bottom portion includes: a peripheral portion having an annular shape; a protruding ridge disposed radially inward of the peripheral portion and configured to serve as a ground contacting portion of the synthetic resin bottle by protruding downward from the peripheral portion and configured, when being deformed under the reduced pressure, to make the peripheral portion serve as the ground contacting portion by being displaced toward the inside of the synthetic resin bottle; and a depressed recess located radially inward of the protruding ridge and depressed toward the inside of the synthetic resin bottle, the peripheral portion includes a plurality of groove portions extending radially, and wherein, in a bottom view, each of the plurality of groove portions has a substantially triangular shape and the substantially triangular shape is tapered from a side wall of the bottle toward a bottom center of the bottom portion of the bottle which causes each groove portion to narrow radially inward.

2. The synthetic resin bottle of claim 1, wherein the plurality of groove portions is distributed at an equal interval in a circumferential direction.

* * * * *